US005488745A

United States Patent [19]

Barrera

[11] Patent Number: 5,488,745

[45] Date of Patent: Feb. 6, 1996

[54] ON-GROUND SWIMMING POOL

[75] Inventor: Joseph Barrera, Danville, Pa.

[73] Assignee: Wilkes Pool Corporation, Mifflinville, Pa.

[21] Appl. No.: 349,201

[22] Filed: Dec. 5, 1994

[51] Int. Cl.[6] ..... E04H 4/00

[52] U.S. Cl. ..... 4/506

[58] Field of Search ..... 4/506, 496; 52/223.2, 52/223.3, 270

[56] References Cited

U.S. PATENT DOCUMENTS 3,638,245 2/1972 Birkmeir ..... 4/506 X 4,562,603 1/1986 Paradis ..... 4/506

*Primary Examiner*—Charles E. Phillips

*Attorney, Agent, or Firm*—Lalos & Keegan

[57] ABSTRACT

An on-ground pool generally consisting of a peripheral support wall including a pair of side wall sections and a pair of end wall sections, a peripheral mounting rail structure mounted on the wall structure, having a downwardly opening channel-shaped portion receiving the wall structure and an outwardly opening channel-shaped portion, a plurality of peripherally spaced, outwardly projecting compression struts having the inner ends thereof received within the outwardly opening channel portions of the rail structure and rigidly secured to the rail structure, a peripheral facia structure having an inwardly opening channel portion receiving outer ends of the compression struts therein, the outer ends of the compression struts being rigidly secured to the facia structure, decking disposed on and secured to the compression struts, a tension rod disposed on each side and end section of the wall structure, engaging the compression struts and secured at its ends to the rail structure at the ends of the wall or end section, the tension rods cooperating to form a peripheral chord, placing the compression struts in compression sufficient to counteract outwardly directed forces of a body of water disposed within the wall structure and a liner disposed within the peripheral wall structure, having a peripheral edge secured to the rail structure for holding the body of water therein.

29 Claims, 5 Drawing Sheets

ON-GROUND SWIMMING POOL

This invention relates to a swimming pool construction and more particularly to an on-ground type of swimming pool.

In the prior art, there has been developed and in widespread usage a type of swimming pool commonly referred to as an on-ground pool which generally consists of a peripheral wall structure mounted on the ground and usually having a deck along the upper end thereof and a liner disposed within the wall structure and having a peripheral portion thereof secured to the upper end of the wall structure for receiving and holding a body of water. Typically, the components of such pools are manufactured, packaged and sold to end users in kit form for assembly by such purchasers. Because such pools are intended to be purchased and assembled by end users, usually home owners, it is essential that such pools be not only easy to assemble but sufficiently sturdy to withstand the pressure exerted by the body of water on the wall structure. Many of the prior art on-ground pool constructions, however, have not been found to provide an on-ground swimming pool construction which is not only comparatively simple to assemble but sturdy in construction and dependable in use.

Accordingly, it is the principal object of the present invention to provide an improved swimming pool construction.

Another object of the present invention is to provide an improved on-ground type of swimming pool construction.

A further object of the present invention is to provide an on-ground type of swimming pool construction which is comparatively simple in design and relatively easy to assemble by persons having ordinary mechanical skills.

A still further object of the present invention is to provide an improved on-ground type of swimming pool construction which is sturdy in construction and reliable in use.

Another object of the present invention is to provide an improved type of on-ground swimming pool construction in which the components thereof are interlocked with each other in a manner to provide an integral structure of increased strength and rigidity.

A further object of the present invention is to provide an improved type of on-ground swimming pool construction which is comparatively inexpensive to manufacture and market through commercial outlets to homeowners and other consumers.

Other objects and advantages of the present invention will become more apparent to those persons having ordinary skill in the art to which the present invention pertains from the following description taken in conjunction with the accompanying drawings wherein.

Figure 1:
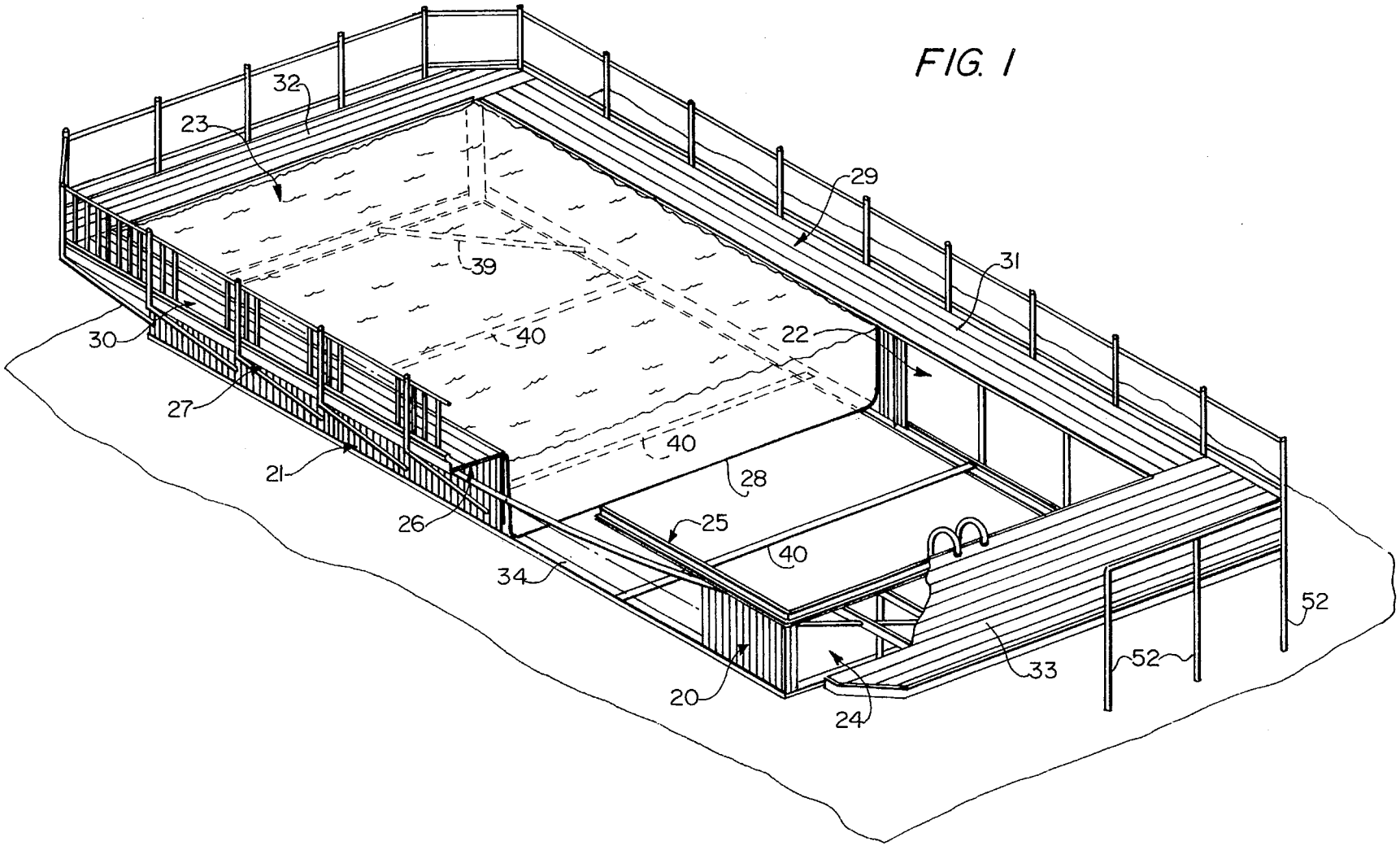
FIG. 1 is a perspective view of an on-ground swimming pool construction embodying the present invention.

Referring to FIG. 1, there is illustrated an on-ground swimming pool construction embodying the present invention which generally includes a peripheral support wall structure 20 having a pair of elongated side wall sections 21 and 22 and a pair of end wall sections 23 and 24, a peripheral mounting rail structure 25 mounted on the upper end of wall structure 20, a plurality of compression struts 26 mounted on the inner ends thereof on the rail structure and projecting outwardly therefrom in cantilevered fashion, a peripheral facia structure 27 secured to the outer ends of the compression struts, a liner 28 disposed within the peripheral wall structure and having a peripheral edge secured to the peripheral rail structure and decking 29 supported on the compression members between the rail and facia structures including side deck sections 30 and 31, an end deck section 32 and an enlarged end deck section 33 providing a patio area.

As best shown in FIGS. 1 through 5, the wall structure consists of a plurality of base plate members 34 disposed in end-to-end relation about the periphery of the wall structure, a set of corner post members 35 secured at their lower ends to the base plate members, a plurality of post members 36 secured at their lower ends to the base plate members and spaced between the corner post members and a plurality of wall components 37 supported on the base plate members, interconnected in side-by-side relation and secured to the post members. Each of the base plate members consists of an elongated rectangular section 34*a* provided with an inwardly disposed, downwardly projecting flange section 34*b* and an outwardly disposed, upwardly projecting flange section 34*c*. Adjoining portions of the base members are rigidly secured together by means of connector plates and adjacent base plate members at each corner of the wall structure are secured together by a corner plate member 38. The base plate members adjacent each corner of the wall structure are further maintained in position 90° apart by means of a corner strap 39, and opposing sides of the assembled base plate members are retained in parallel relation by means of a plurality of base straps 40.

Figure 2:
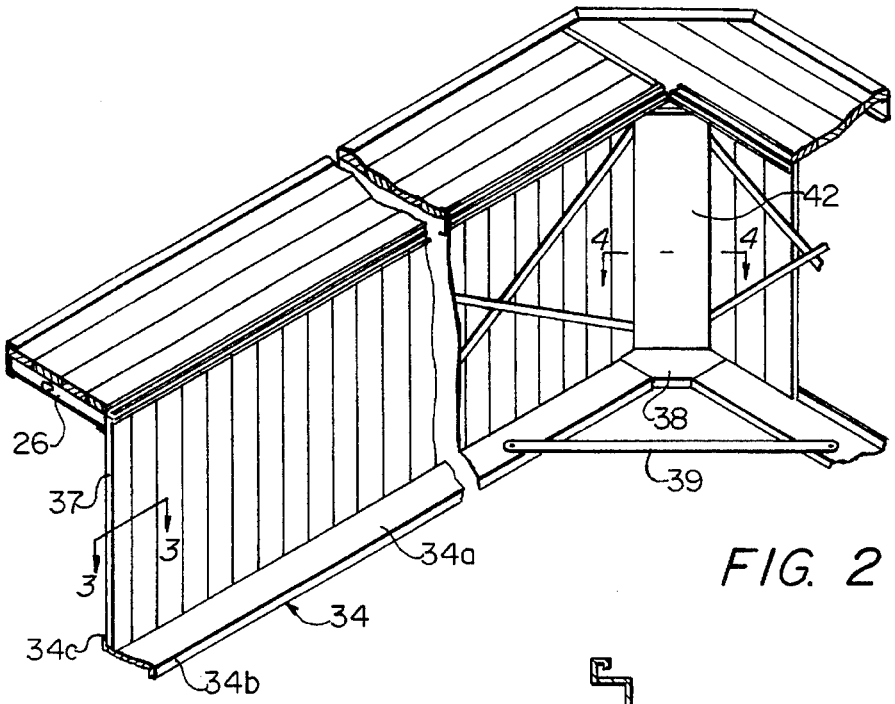
FIG. 2 is an enlarged perspective view of a portion of the wall and decking structure of the embodiment shown in FIG. 1.
Figure 3:
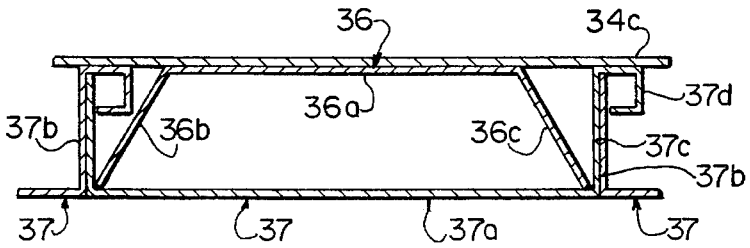
FIG. 3 is an enlarged cross-sectional view taken along line 3—3 in FIG. 2.

Each corner post member has substantially a C-shaped cross-sectional configuration including a pair of side sections 35*a* and 35*b* disposed 90° apart, provided with flange portions 35*c* and 35*d*. Such members are seated on corner plate members 38 and are rigidly secured to outwardly disposed, upwardly projecting flange portions thereof with the open side thereof facing inwardly. Each of the post members 36 has a channel-shaped configuration including a base portion 36*a* and a pair of flaring flange portions 36*b* and 36*c*. The lower ends of such members are seated on base plate members 34 with the open sides thereof facing inwardly and the lower edges of base portions 36*a* secured to base plate flange portions 34*c* as best shown in FIGS. 2 and 3.

Each wall component 37 also has a substantially C-shaped configuration including a base section 37*a* and a pair of flange sections 37*b* and 37*c*. Flange section 37*c* has a substantially J-shaped configuration providing an inwardly turned portion 37*d* providing a slot for receiving a flange section 37*b* of an adjoining wall component in interlocking relation. The wall components are disposed in side-by-side, interlocked relation, supported on base plate members 34, receiving said post members 36 therein as shown in FIG. 3 and having flange portions thereof interlocked with the corner post members as shown in FIG. 4.

Figure 5:
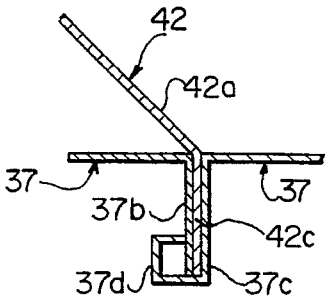
FIG. 5 is an enlarged view of the detail designated in FIG. 4.
Figure 4:
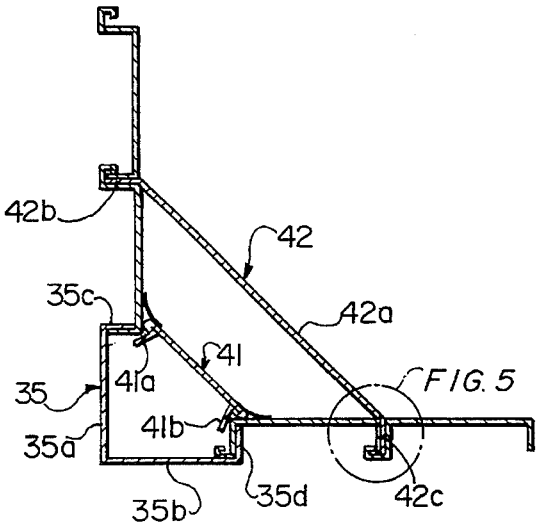
FIG. 4 is an enlarged cross-sectional view taken along line 4—4 in FIG. 2.

Referring to FIG. 4, it is to be noted that a pair of end wall components are connected to and interlocked with a post member by means of a flange section 37*c* of one end wall component being received within the corner post member and disposed along the inner side of a corner post flange portion 35*d*, an annular flange portion 37*b* of the other end wall component being received within the corner post member and disposed on the inner side of a corner post flange portion 35*c* and a corner fillet component 41 disposed across the opening in the corner post member, having inwardly projecting tabs 41*a* and 41*b* projecting into the corner post member and biased outwardly to engage wall component sections 37*b* and 37*c* against corner post flange portions 35*c* and 35*d*, respectively, to lock the end wall components to the corner post member and retain the fillet member in the position as shown. Each corner further is provided with a corner wall component 42 having a base section 42*a* disposed substantially parallel to fillet member 41 and a pair of flange sections 42*b* and 42*c* which are adapted to be received between adjacent flange sections of each end wall component and an adjacent wall component as best shown in FIG. 5.

Mounting rail structure 25 consists of a plurality of rail components 43 connected together in end-to-end relation about the periphery of the wall structure. As best illustrated in FIGS. 6 and 7, each component 43 consists of an elongated aluminum extrusion provided with a downwardly projecting channel-shaped section 43*a* adapted to receive therein the upper portion of wall structure 24 for supporting the support rail structure on the wall structure, an outwardly opening channel-shaped section 43*b* receiving an inner end portion of the decking structure, a second, outwardly opening channel-shaped section 43*d* receiving a portion of the liner edge welting and an upwardly opening channel-shaped section 43*d* having a restricted opening portion for receiving a snap fitting portion 44*a* of a coping 44 adapted to overlie the rail component and having edge portions engaging the decking and liner.

Figure 11:
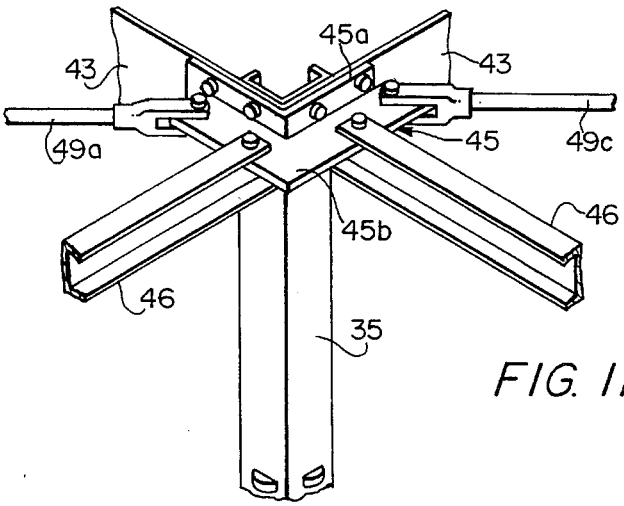
FIG. 11 is an enlarged perspective view of a corner assembly of the embodiment shown in FIG. 1, having portions thereof broken away.

Along the side and end sections of the wall structure, adjacent rail components are secured together by bridging connector plates. At the corners of the wall structure, adjacent rail components are secured together by corner connector plates 45, as best shown in FIG. 11. Each of such corner connector members includes a vertically disposed, L-shaped section 45*a* rigidly secured by bolts to a pair of adjacent rail components 43 and the upper end of a corner post member 35, and an integral, horizontally disposed L-shaped section 45*b*.

Figure 6:
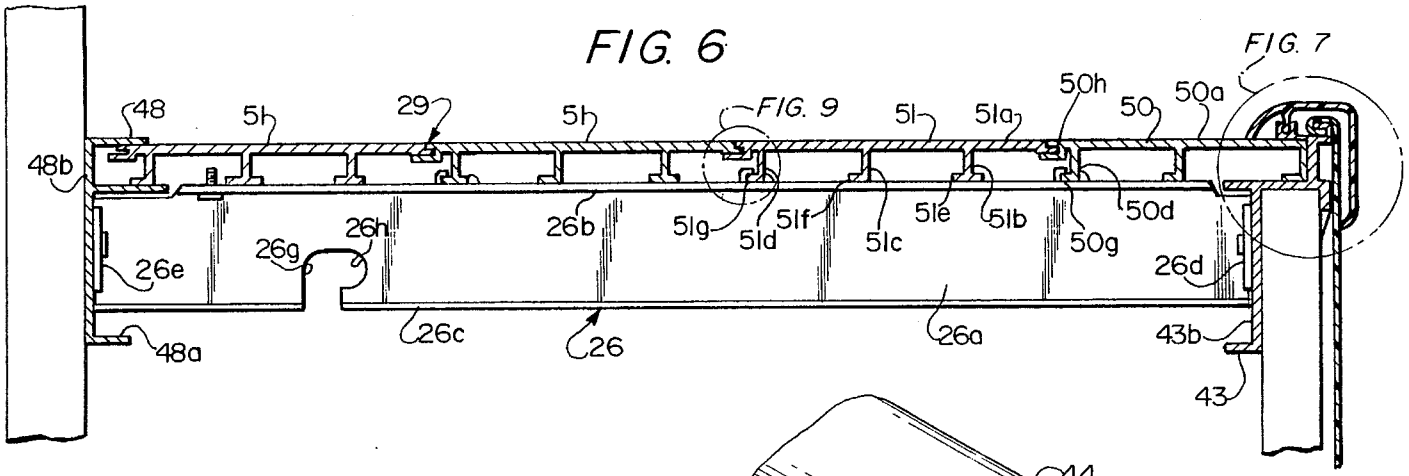
FIG. 6 is an enlarged cross-sectional view of a portion of the wall structure and decking of the embodiment shown in FIGS. 1 and 2.
Figure 7:
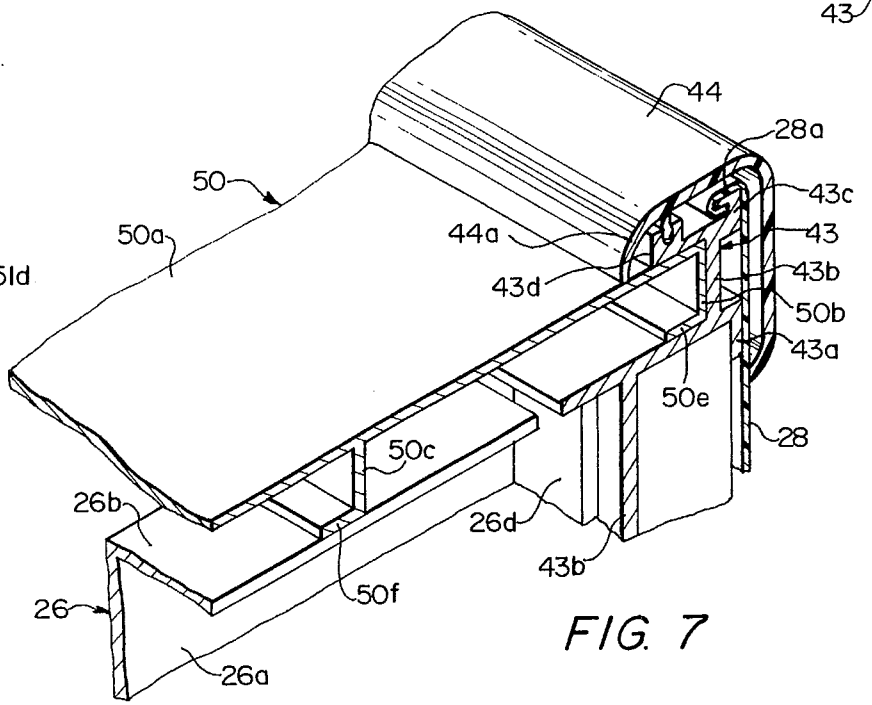
FIG. 7 is an enlarged perspective view of the detail designated in FIG. 6.
Figure 9:
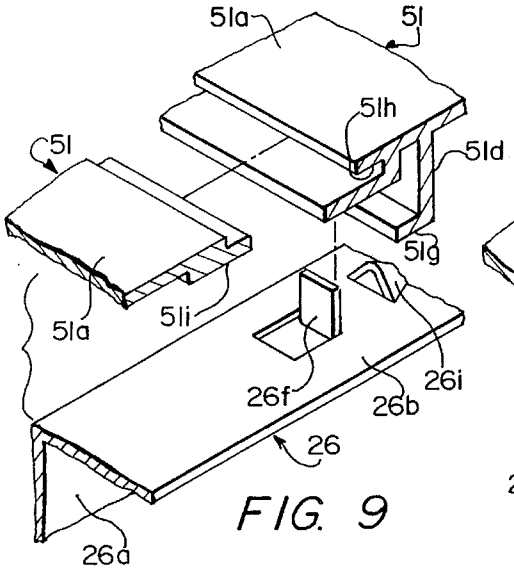
FIG. 9 is an enlarged perspective view of the detail designated in FIG. 6.
Figure 10:
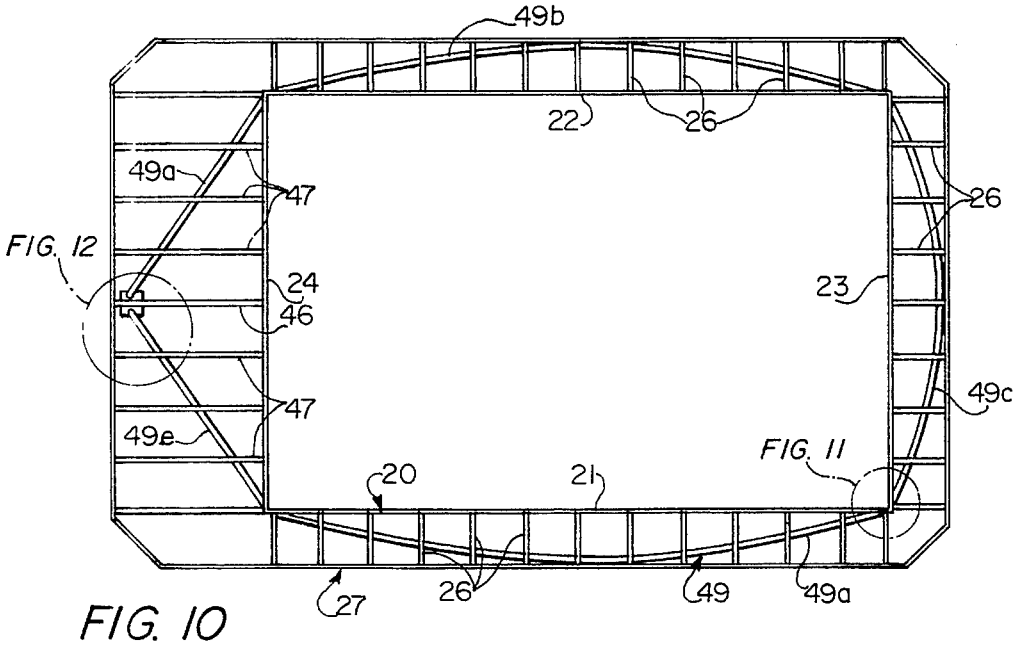
FIG. 10 is a top plan view of the embodiment shown in FIG. 1, illustrating the manner in which inwardly directed compressive forces are applied to the peripheral wall structure of the embodiment.

The compression struts disposed on the side and one of the end sections of the pool structure are of a construction as shown in FIGS. 6 through 9 of the drawings. Each strut has an elongated, channel-shaped configuration including a web section 26*a*, an upper flange section 26*b* and a lower flange section 26*c*. The inner end of each strut is received within an outwardly opening channel section 43*b* of a rail component, and is secured to the rail component and a post member of the wall structure by means of a bolt extending through an end flange portion 26*d* of web section 26*a* of the strut, as best shown in FIG. 6. The opposite end of the strut is provided with a similar flange portion 26*d* for securing the outer end of the strut to the facia structure. Flange section 26*b* of each of the struts is provided with a plurality of upwardly-struck retaining tabs 26*f* which function to secure the decking to the struts as later will be described, and the web and lower flange sections of the strut is provided with an indentation 26*g* for receiving a portion of the torsion rod therethrough. The distance of indentation 26*g* from the inner end of the strut will vary with each strut depending upon the location of the strut. The distance of the indentation relative to the inner end of the strut will be the greatest on the struts located at the center of a side wall of the pool structure and will diminish on struts located in directions from the center of the wall structure to the ends thereof as indicated in FIG. 10. As best shown in FIG. 6, a portion of the inner edge of each indentation 26*g* is further recessed with a curved surface, as at 26*h*, to better accommodate the portion of a torsion rod extending therethrough. Optionally, the indentation may be closed to assure the retention of the torsion rod passing through the indentation by means of a retainer plate bolted on the bottom side of lower flange section 26*c*. Such a retaining plate further would add rigidity to the strut at the point of the indentation.

Figure 12:
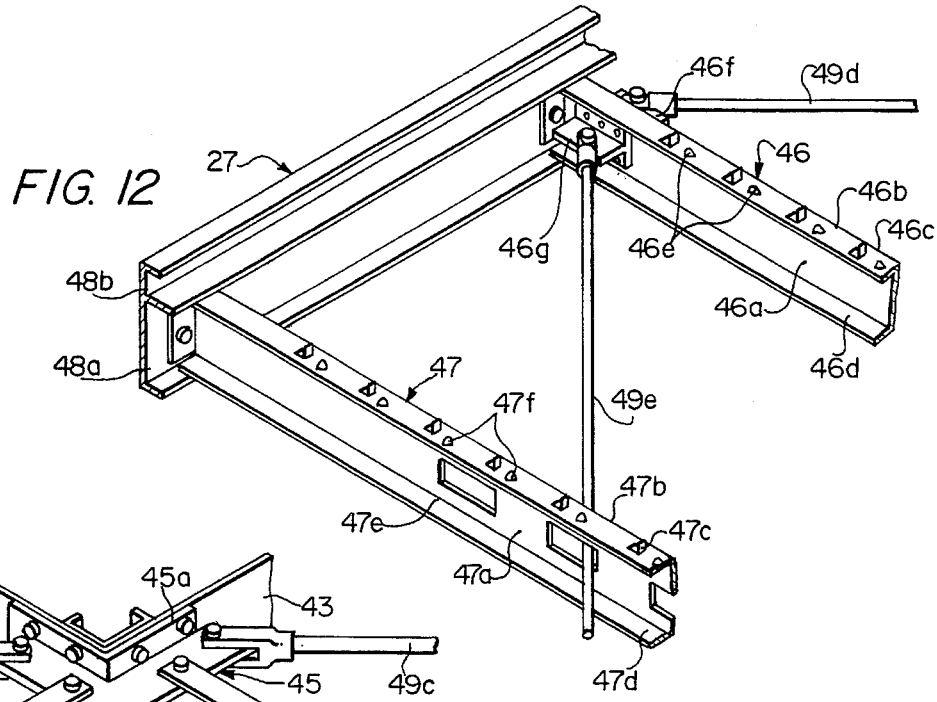
FIG. 12 is an enlarged perspective view of the support structure for the patio portion of the embodiment shown in FIG. 1, having portions thereof broken away.

The compression struts at the patio end of the pool structure include a center compression strut 46 and plurality of struts 47 spaced laterally relative to center strut 46. Struts 46 and 47 are substantially similar in construction and function to compression struts 26 but are longer in length. As best shown in FIG. 12, center patio strut 46 includes a web section 46*a* having inwardly turned end flange portions for securing the ends of the strut to the rail structure and the facia structure, an upper flange section 46*b* provided with a plurality of upstruck tabs 46*c* and a lower flange 46*d*. The inner end of web section 46*a* further is provided with a pair of tension rod connecting plates 46*e* and 46*f* for securing end portions of torsion rod segments to the outer end of compression strut 46. Each of compression struts 47 similarly includes a web section 47*a* provided with inwardly bent flange portions at the ends thereof for securing the strut to the rail structure and the facia structure, an upper flange section 47*b* provided with a plurality of spaced upstruck retaining tabs 47*c* and a lower flange section 47*d*. The web section of each strut further is provided with a plurality of spaced openings 47*e* for receiving portions of torsion rod segments therethrough as indicated in FIG. 12.

The inner ends of the compression struts disposed at the ends of the side and end sections of the wall structure are modified slightly so that they may be secured to the corner plates instead of the rail structure directly as illustrated in FIG. 11.

Figure 8:
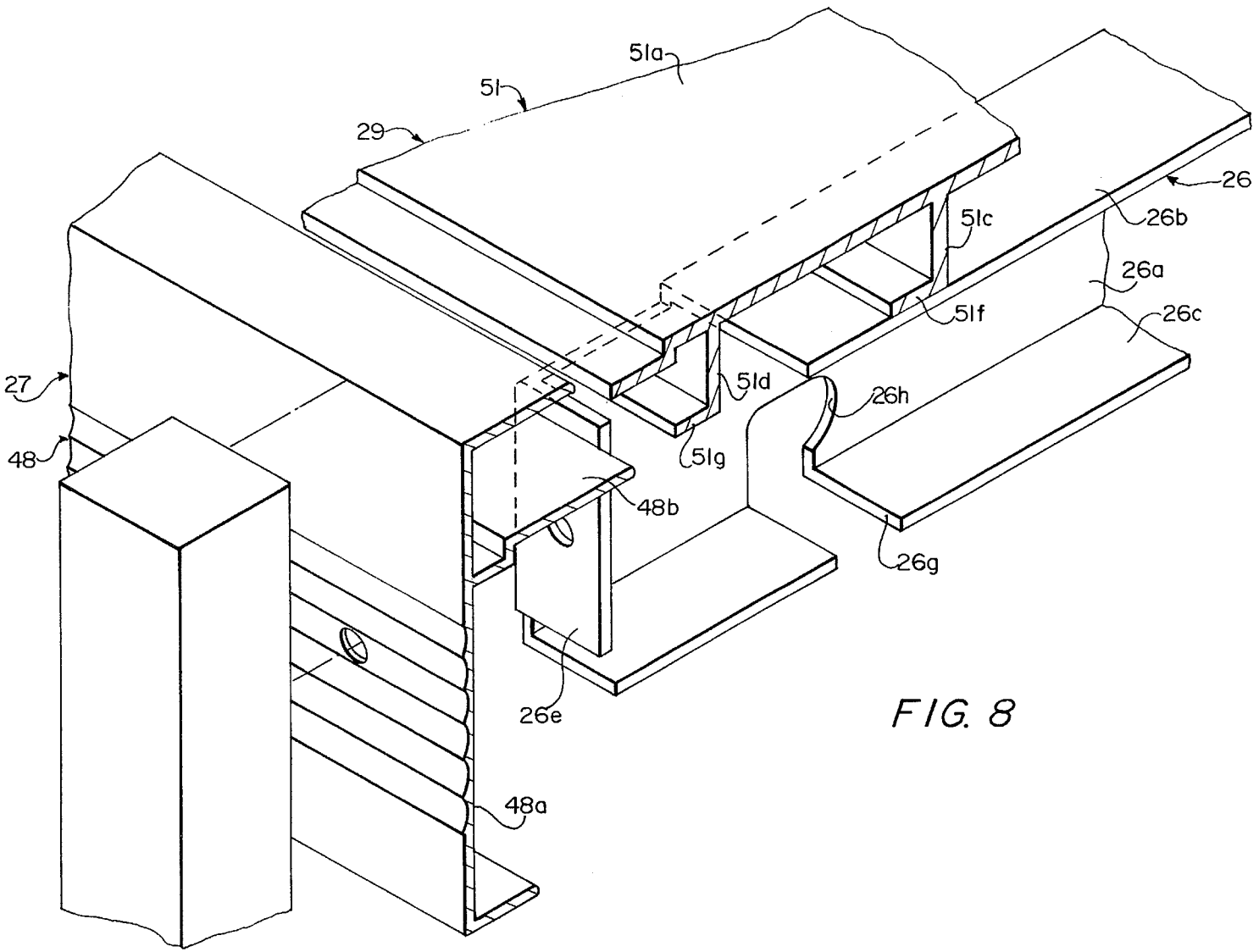
FIG. 8 is an enlarged perspective view of an outer end portion of the structure shown in FIG. 6, illustrating the components in exploded relation.

Facia structure 27 also consists of a plurality of elongated extruded components 48 secured together in end-to-end relation, encompassing the outer ends of the compression struts. As best shown in FIGS. 6, 8 and 12, each facia component 48 includes a lower channel-shaped section 48*a* receiving and having secured thereto the outer ends of the compression struts, and an upper channel-shaped section 48*b* receiving the outer sides of decking 29. The outer ends of the compression struts are secured to the facia components by means of bolts extending through flange portions 26*e* on compression struts 26 and comparable flange portions on patio compression struts 46 and 47.

The compression struts and the sections of the wall structure are placed in compression by means of a tension member 49 encompassing the compression struts and bearing upon both the compression struts and the sections of the wall structure. As best shown in FIG. 10, the torsion member comprises torsion rod segments 49*a*, 49*b*, 49*c*, 49*d* and 49*e*. Torsion rod segment 49*a* extends through indentations 26*g* in compression struts 26 and is secured to a set of corner connector plates 45, as shown in FIG. 11, located at the ends of wall section 21. Similarly, torsion rod segment 49*b* extends through similar indentations 26*h* in compression struts 26 disposed along wall section 22 and is secured at its ends to corner connector plates similar to corner connector plate 45. Torsion rod segment 49*c* passes through indentations 26*g* disposed in compression struts 26 along wall section 23 and is connected to corner connector plates at the end of the wall section. Each of torsion rod segments 49*d* and 49*e* pass through openings 47*e* in compression struts 47, are connected at inner ends to corner connector plates disposed at the ends of wall section 24 and are connected at the outer ends thereof to connector plates 46*e* and 46*f* rigidly secured to the outer end of compression strut 46. Each of such segments is provided with a conventional turnbuckle so that the segments can be drawn taut to apply inwardly directed compression forces to compression struts 26, 46 and 47, about the periphery of the support rail structure, and further to place each side of the mounting rail structure under opposed compressive forces, which function to counteract the forces applied by the body of water against the side walls of the pool structure.

The decking supported on and secured to the compression struts includes a plurality of extruded components 50 and 51. Each of deck components 50 includes an elongated planar section 50*a* having depending leg sections 50*b*, 50*c* and 50*d* provided with foot portions 50*e*, 50*f* and 50*g*, respectively. The inner sides of each decking component 50 is received within channel-shaped portions 43*c* of the rail components and the foot portions thereof rest on the rail components and the compression struts. As shown in FIG. 6, a retaining tab 26*f*, 46*c* or 47*c* is bent over a foot portion 50*g* to firmly secure each of decking components 50 to the compression struts. Each of the sections 50*a* further is provided with a groove 50*h* along an outer side thereof for receiving a tongue portion of an adjoining decking component 51.

Each of decking components 51 includes an elongated planar section 51*a* and a plurality of leg sections 51*b*, 51*c* and 51*d* provided with foot portions 51*e*, 51*f* and 51*g*, respectively, supported on the compression struts. Decking components 51 are secured to the compression struts by means retainer tabs 26*f*, 46*c* and 47*c* bent over and engaging one or more of the foot portions of such components. The outer side of each decking section 51*a* is provided with a groove 51*h* and the inner side of such section is provided with a tongue portion 51*i* so that each tongue portion 51*i* is received within a groove 50*h* or 51*h* to interlock the decking components in side-to-side relation between the support rail structure and the facia structure. As best shown in FIGS. 6 and 8, the outermost decking components 51 are received within channel-shaped portions 48*b* of the facia components to provide a level and finished deck surface about the perimeter of the pool structure.

Liner 28 is secured to the wall structure by means of an upper peripheral welting edge 28*a* thereof being received within channel-shaped sections 43*d* of the rail components and maintained therein by means of a plurality of spaced clips. The connection of the liner to the rail components is covered by a plurality of coping strips 44 having a section overlying the rail structure and secured thereto by means of protruding portion 44*a* received within channel-shaped portions 43*e* and a depending section overlying an upper portion of the liner.

In the installation of the pool structure as described, the pool site is first prepared by excavating, shaping and grading the ground as desired. Assuring that the ground is level, the base plates are positioned on the ground and secured together in end-to-end relation by means of connector plates. Such plates are positioned with their downwardly projecting flange sections disposed inwardly and inserted into the ground, and the upwardly projecting flange sections being disposed on the outward side. The side and corner post members are then positioned on the base plates and secured thereto with the web portions of the side post members abutting the inner sides of the outer flange sections of the base plates. The mounting rail members are then mounted on the side and corner post members and secured to each other in end-to-end relation. In doing so, the corner connector plates are secured to each set of adjoining rail members at each corner of the pool structure. With the rail members mounted on the post members and firmly secured together in end-to-end relation and the corner connector plates mounted at the corners, three compression struts 26 are mounted on each side portion of the structure and secured to the rail members, and two compression struts 26 are mounted on the end of the structure opposite the patio end thereof and also secured to the rail members. Next, deck components 50 are positioned on the inner ends of the compression struts, inserted within the rail members and secured to the compression struts. The facia components are then mounted and secured on the ends of the compression struts.

The rest of compression struts 26 are then assembled so that each of such struts is firmly bolted at its inner end to a rail member and a post member of the wall structure and rigidly secured at their outer ends to the facia members. The compression struts disposed at the ends of the side walls and the end wall opposite the patio end will be secured to the corner connector plates as shown in FIG. 11. The torsion rod segments are then installed by inserting the rod segments along their length into the indentations provided in the compression struts and then securing the ends thereof to the corner connector plates. The decking is then completed by assembling and securing decking members 51, working outwardly, interlocking such components together and providing for the outermost members to be received within channel-shaped portions 48*b* of the facia members.

The patio portion of the pool structure may then be assembled by securing the outer ends of compression struts 46 and 47 to the rail components along end section 24 of the pool structure, supporting the outer ends thereof on post members 52, assembling the deck and facia members in the manner as previously described and then installing tension rod segments 49*d* and 49*e*. With all compression struts assembled and rigidly secured to the wall sections, the turnbuckles of the torsion rod segments may be turned to suitably place all of the compression struts and rail components in compression.

The liner is then laid out within the wall structure and the peripheral edge thereof is secured to the rail structure in the manner as previously described and the coping is placed on the rail structure to complete the basic assembly of the pool. In the typical manner, a hand rail may be installed about the deck and patio portions of the pool and ladders may be provided on the wall structure. Although the compression struts, decking and facia structure are adequately supported on the wall structure in the manner described, additional post members may be secured to the base of the wall structure and connected on the outer, upper ends thereof to the facia components to further rigidify such outboard structure.

In the manufacture of the various described components of the pool structure, it is contemplated that the rail, decking and facia components be fabricated of elongated aluminum extrusions, and that the base plates, post members and wall components be of a formed sheet metal construction. The tension rod segments also may consist of rod segments or metal cable having steel clevises or other fixtures for securing such segments to the corner connector plates and the connector plates in the patio area. The liner may be of any commercially available material suitable for swimming pools and the coping components also may be constructed of any suitable material such as vinyl and the like.

From the above description, it will be appreciated that there is provided a pool construction formed of a comparatively few number of components that may be easily assembled and secured together to provide a structure sufficient to hold a body of water in a sturdy and safe manner to enable its use for recreational purposes.

From the foregoing detailed description, it further will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An on-ground pool comprising:

a peripheral wall structure including a pair of side wall sections and a pair of end wall sections;

a peripheral rail structure mounted on said wall structure, having a downwardly opening channel portion receiving said wall structure and an outwardly opening channel portion;

a plurality of peripherally spaced, outwardly projecting compression struts having the inner ends thereof received within said outwardly opening channel portion of said rail structure and rigidly secured to said rail structure;

a peripheral facia structure having an inwardly opening channel portion receiving outer ends of said compression struts therein, said outer ends of said compression struts being rigidly secured to said facia structure;

decking disposed on and secured to said compression struts;

a tension rod disposed on each section of said wall structure, engaging said compression struts and secured at its ends to said rail structure at the ends of said section, said tension rods cooperating to form a peripheral chord, placing said compression struts in compression sufficient to counteract outwardly directed forces of a body of water disposed within said wall structure; and a liner disposed within said peripheral wall structure, having a peripheral edge secured to said rail structure for holding said body of water therein.

2. An on-ground pool according to claim 1 wherein said peripheral wall structure comprises a plurality of wall components secured together in side-by-side relation.

3. An on-ground pool according to claim 2 wherein adjacent wall components are interlocked together.

4. An on-ground pool according to claim 2 wherein each of said wall components has a channel-shaped cross-sectional configuration.

5. An on-ground pool according to claim 1 including base straps interconnecting portions of opposed side sections of said wall structure.

6. An on-ground pool according to claim 1 wherein said wall structure includes a peripheral base structure.

7. An on-ground pool according to claim 6 wherein said peripheral base structure comprises a plurality of interconnected base components disposed in end-to-end relation.

8. An on-ground pool according to claim 1 wherein the compression struts along an end section of said wall structure are of greater length than the other compression struts and are supported at the outer ends thereof on post members, and the decking thereon extends outwardly a greater distance than the decking on the other sides of said wall structure to provide a patio area.

9. An on-ground pool according to claim 1 wherein said wall structure comprises a peripheral base structure comprising a plurality of interconnected base components disposed in end-to-end relation, a plurality of peripherally spaced post members rigidly secured at the lower ends thereof to said base structure and at the upper ends thereof to said rail structure, and a plurality of wall components interconnected in side-by-side relation and to said post members.

10. An on-ground pool according to claim 9 wherein each of said wall components and said post members has a channel-shaped cross-sectional configuration.

11. An on-ground pool according to claim 9 wherein each of said base components includes an outwardly disposed, upwardly projecting flange to which said post members are secured and an inwardly disposed, downwardly projecting flange insertable into the ground to resist lateral displacement of said base structure.

12. An on-ground pool according to claim 1 wherein said rail structure comprises a plurality of interconnected components disposed in end-to-end relation.

13. An on-ground pool according to claim 12 wherein said rail components comprise elongated extrusions.

14. An on-ground pool according to claim 12 wherein said rail components comprise elongated aluminum extrusions.

15. An on-ground pool according to claim 12 wherein adjacent rail components disposed at each corner of said rail structure are provided with an L-shaped corner member rigidly secured to said adjacent rail components and to which adjacent ends of a pair of torsion bars are secured.

16. An on-ground pool according to claim 1 wherein said rail structure is provided with a second outwardly opening channel-shaped portion in which an inner side of said decking is received.

17. An on-ground pool according to claim 1 wherein said rail structure is provided with an inwardly opening channel-shaped portion in which a peripheral welting portion of said liner is received and secured.

18. An on-ground pool according to claim 17 including a peripheral coping mounted on and secured to said rail structure overlying the securement of said liner welting to said rail structure.

19. An on-ground pool according to claim 1 wherein each of said compression struts is rigidly secured to said rail structure and a post member of said wall structure.

20. An on-ground pool according to claim 1 wherein each of said compression struts is provided with an opening through which a torsion rod portion extends and bears against said compression strut to place said wall and rail structures in compression.

21. An on-ground pool according to claim 20 wherein in at least some of said compression struts, said opening comprises an indentation in an underside thereof.

22. An on-ground pool according to claim 1 wherein each of said compression struts is provided with at least one upwardly extending tab bent over against a portion of said decking for rigidly securing said decking portion to said compression strut.

23. An on-ground pool according to claim 1 wherein said facia structure comprises a plurality of components secured together in end-to-end relation.

24. An on-ground pool according to claim 1 wherein said facia structure includes a second inwardly projecting channel-shaped portion in which an outer side of said decking is received.

25. An on-ground pool according to claim 23 wherein each of said facia components comprises an aluminum extrusion.

26. An on-ground pool according to claim 1 wherein said decking comprises a plurality of components disposed in side-by-side relation.

27. An on-ground pool according to claim 26 wherein adjacent deck components are interlocked together.

28. An on-ground pool according to claim 1 wherein said wall structure includes a plurality of peripherally spaced post members and a plurality of wall components secured together and to said post member in side-by-side relation.

29. An on-ground pool according to claim 28 wherein each of said post members has a channel-shaped cross-sectional configuration.

* * * * *